US011615929B2

(12) United States Patent
Kreuzpointner et al.

(10) Patent No.: US 11,615,929 B2
(45) Date of Patent: Mar. 28, 2023

(54) SWITCHING DEVICE WITH AT LEAST TWO INTERCOMMUNICATING EXTINGUISHING AREAS

(71) Applicant: Schaltbau GmbH, Munich (DE)

(72) Inventors: Korbinian Kreuzpointner, Oberding (DE); Andrej Ignatov, Munich (DE); Martin Geschke, Munich (DE); Johannes Schmid, Vienna (AT)

(73) Assignee: Schaltbau GmbH, Munich (DE)

( * ) Notice: Subject to any disclaimer, the term of this patent is extended or adjusted under 35 U.S.C. 154(b) by 0 days.

(21) Appl. No.: 17/178,236

(22) Filed: Feb. 17, 2021

(65) Prior Publication Data

US 2021/0257173 A1 Aug. 19, 2021

(30) Foreign Application Priority Data

Feb. 18, 2020 (DE) ..... 10 2020 104 258.2

(51) Int. Cl.
*H01H 33/70* (2006.01)
*H01H 33/53* (2006.01)

(52) U.S. Cl.
CPC ..... *H01H 33/70* (2013.01); *H01H 33/53* (2013.01)

(58) Field of Classification Search
CPC ..... H01H 9/30; H01H 9/342; H01H 9/36; H01H 9/443; H01H 33/53; H01H 33/70; H01H 33/60; H01H 50/546; H01H 9/32
(Continued)

(56) References Cited

U.S. PATENT DOCUMENTS 5,004,874 A 4/1991 Theisen et al.
6,897,760 B2 * 5/2005 Kawata ..... H01H 9/342 200/306

(Continued)

FOREIGN PATENT DOCUMENTS

DE 11 2017 006 556 T5 9/2019
JP 1968013156 Y 6/1968

(Continued)

OTHER PUBLICATIONS

European Search Report in related European Patent Application No. 21157513.9 dated Jul. 20, 2021 (six pages).

(Continued)

*Primary Examiner* — William A Bolton
(74) *Attorney, Agent, or Firm* — Kilpatrick Townsend & Stockton LLP

(57) ABSTRACT

Switching device with closable contacts and an extinguishing chamber which is associated with the contacts and has a first extinguishing area and a second extinguishing area arranged directly adjacent to the first extinguishing area, the first extinguishing area and the second extinguishing area being spatially separated from each other by a partition wall, and the switching device being configured in such a way that a switching arc which is generated when opening the contacts is always blown away from the point where it is generated in one of the two extinguishing areas by means of an arc blowing means of the switching device and is caused to be extinguished, whereas the respective other of the two extinguishing areas is not used for extinguishing, characterized in that the partition wall between the first extinguishing area and the second extinguishing area has at least one overflow opening which connects the first extinguishing area to the second extinguishing area in such a way that plasma which is generated by the switching arc can flow from the (Continued)

Figure 1:
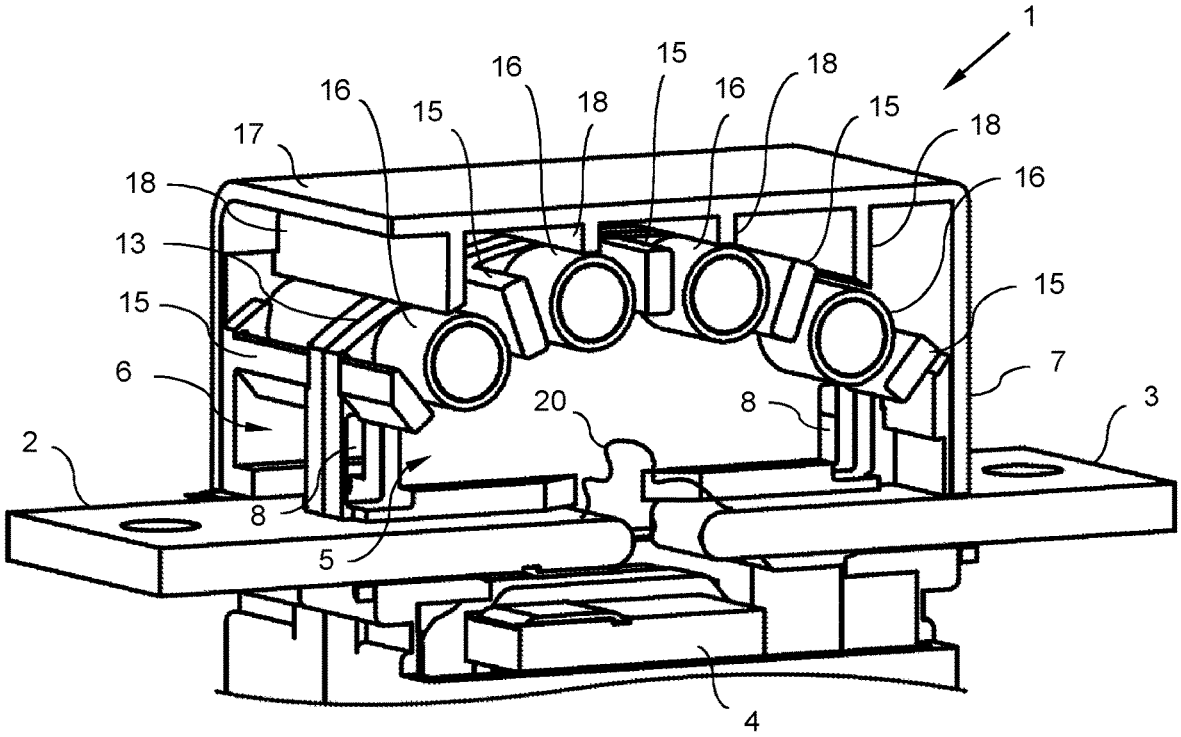

extinguishing area in which the switching arc is caused to be extinguished into the respective other, unused extinguishing area.

12 Claims, 2 Drawing Sheets

(58) Field of Classification Search
USPC ... 218/48, 47, 46, 51, 30, 31, 22, 23, 34, 35
See application file for complete search history.

(56) References Cited

U.S. PATENT DOCUMENTS

| | | | | |
|---|---|---|---|---|
| 8,368,492 | B1 * | 2/2013 | Theisen | H01H 9/36 335/201 |
| 9,478,373 | B2 * | 10/2016 | Valivainio | H01H 19/04 |
| 9,552,944 | B2 * | 1/2017 | Baujan | H01H 33/182 |
| 9,721,739 | B2 * | 8/2017 | Kopf | H01H 9/346 |
| 9,947,489 | B2 * | 4/2018 | Kralik | H01H 73/18 |
| 10,056,210 | B2 * | 8/2018 | Marzano | H01H 9/342 |
| 2013/0112655 | A1 | 5/2013 | Theisen et al. | |
| 2014/0061160 | A1 | 3/2014 | Juds et al. | |
| 2015/0048911 | A1 * | 2/2015 | Dauer | H01H 9/443 335/207 |

FOREIGN PATENT DOCUMENTS

| | | | |
|---|---|---|---|
| JP | 11979069371 | U | 5/1979 |
| JP | S63 42724 | B2 | 8/1988 |
| JP | 1991182020 | A | 8/1991 |

OTHER PUBLICATIONS

India Examination Report in related Indian Patent Application No. 202144004461 dated Sep. 9, 2021 (five pages).

Japanese Office Action, dated Mar. 14, 2022 of corresponding Japanese Application No. 2021-023798 (with English Translation) (13 pages).

* cited by examiner

SWITCHING DEVICE WITH AT LEAST TWO INTERCOMMUNICATING EXTINGUISHING AREAS

This application claims priority to German Patent Application No. 10 2020 104 258.2, filed Feb. 18, 2020, the disclosure of which is incorporated by reference herein.

The present invention refers to a switching device according to the preamble of independent claim 1. A generic switching device comprises closable contacts and an extinguishing chamber which is associated with the contacts and has a first extinguishing area and a second extinguishing area arranged directly adjacent to the first extinguishing area, the first extinguishing area and the second extinguishing area being spatially separated from each other by a partition wall, and the switching device being configured in such a way that a switching arc which is generated when the contacts are opened is always blown away from the point where it is generated in one of the two extinguishing areas by means of an arc blowing means of the switching device and is caused to be extinguished, whereas the respective other of the two extinguishing areas is not used for extinguishing.

A switching device according to the preamble of independent claim 1 is known from U.S. Pat. No. 5,004,874. This publication describes a bidirectional contactor in which, depending on the direction of the current, one of the two extinguishing areas is used while the other extinguishing area is not used.

Switching devices according to the preamble of independent claim 1 are used in various fields. There is a general trend towards increasingly smaller and lighter switching devices. In order to prevent damage to adjacent parts and to comply with the increasingly stricter safety regulations, it is necessary to prevent plasma generated by the switching arc during the switch-off process inside the switching device from escaping to the outside.

The switching device known from U.S. Pat. No. 5,004,874 is a closed contactor. However, in known closed contactors of compact construction, the rated switching capacity is relatively limited. At high switching capacities, a relatively large amount of plasma is generated inside the housing, resulting in high overpressure, which without correspondingly greater dimensioning can lead to destruction of the switching device.

It is the object of the present invention to provide a switching device of the generic type, which guarantees a high switching capacity with a compact construction, while at the same time ensuring that the plasma generated inside the housing due to the switching arc does not escape to the outside.

The object is achieved by the features of independent claim 1. Accordingly, in a switching device according to the preamble of independent claim 1, the object according to the invention is achieved if the partition wall between the first extinguishing area and the second extinguishing area has at least one overflow opening which connects the first extinguishing area to the second extinguishing area in such a way that plasma which is generated by the switching arc can flow from the extinguishing area in which the switching arc is caused to be extinguished into the respective other, unused extinguishing area.

Advantageous embodiments of the present invention are the subject matter of the dependent claims.

According to a preferred embodiment of the present invention, it is provided that each of the two extinguishing areas defines a space having a first end nearest to the point of generation of the switching arc, a second end opposite to the first end and towards which the switching arc moves due to the action of the arc blowing means, a first side connecting the first end and the second end, and a second side opposite said first side and also connecting said first end and said second end, wherein said partition wall forms a third side of said space, respectively, and connects said first end, said second end, said first side and said second side, and wherein said space further comprises a fourth side opposite to said partition wall.

Thus, a compact construction is achieved. The distance between the first side and the second side defines a width of the extinguishing area, the distance between the first end and the second end defines a height of the extinguishing area, and the distance between the partition wall and the respective fourth side defines a depth of the extinguishing area. The first end, the second end, the first side, and the second side of the first extinguishing area correspond in position to respective ends and sides of the second extinguishing area. That means for example, that the first side of the first extinguishing area coincides with the first side of the second extinguishing area or is separated from the first side of the second extinguishing area only by the partition wall, respectively. The direction of movement of the switching arc in the first extinguishing area, predetermined by the arc blowing means, runs essentially parallel to the direction of movement of a switching arc to be extinguished in the second extinguishing area. In other words, the arc blowing means ensures that the switching arc, regardless of whether the switching arc is extinguished in the first extinguishing area or in the second extinguishing area, is always blown away in the same direction from the point where it was generated. In this respect, essentially parallel means a deviation of not more than 15°, preferably of not more than 10° and further preferably of not more than 5°. Further preferably, there is parallelism.

Further preferably, the arc blowing means is configured in such a way that the direction of movement of the switching arc is essentially parallel to the partition wall. In this respect, essentially parallel also means a deviation of not more than 15°, preferably of not more than 10°, further preferably of not more than 5° and particularly preferably of 0°.

Further preferably, the arc blowing means is configured in such a way that a longitudinal extension of the switching arc runs essentially parallel to the partition wall. This embodiment also contributes to a compact construction. In this respect, essentially parallel also means a deviation of not more than 15°, preferably not more than 10°, further preferably not more than 5° and particularly preferably 0°.

The sides of each extinguishing area are further preferably formed by side walls.

According to another preferred embodiment of the present invention, the overflow opening is formed on the first side and/or on the second side in the partition wall. The overflow opening(s) is/are preferably located only on the outside of the first side and/or the second side. The central region of the partition wall viewed in the width direction preferably does not have an overflow opening at least near the first end. Further preferably, the central region of the partition wall viewed in the width direction has no overflow opening at least between the first end and preferably provided extinguishing elements arranged at the second end. The middle area of the partition wall without overflow opening viewed in the width direction further preferably occupies at least 70% of the width measured between the first side and the second side. This ensures effective separation between the two extinguishing areas.

It is particularly preferred that an overflow opening is formed in the partition wall on both the first side and the second side. This ensures symmetrical distribution of plasma and non-ionized air.

According to a further preferred embodiment of the present invention, it is provided that the overflow opening is formed in a section of the partition wall facing the first end and facing away from the second end. This also contributes to an effective separation of the two extinguishing areas and leads to an advantageous flow behavior through the overflow opening.

According to a further preferred embodiment of the present invention, extinguishing elements are arranged in each of the two extinguishing areas, into which the switching arc is driven by means of the arc blowing means and thereby caused to be extinguished. Preferably, the extinguishing elements are arranged at the second end or near the second end. Preferably, the extinguishing elements protrude from the partition wall or extend between the partition wall and the respective opposite fourth wall of the respective extinguishing area.

It is particularly advantageous if the overflow opening is formed between the extinguishing elements and a cover or a housing wall of the switching device located at the second end in the partition wall, preferably as an additional overflow opening in addition to the overflow openings described above. This ensures that plasma can flow through the additional overflow opening from the currently used extinguishing area into the unused extinguishing area. Any back-pressure generated by the plasma is reduced or eliminated by the overflow opening, allowing the switching arc to further extend, resulting in a higher switch-off capacity. Preferably, the overflow opening extends essentially over the entire width of the two extinguishing areas measured between the first side and the second side, so that the partition wall (13) actually ends at the level of the extinguishing elements. In this embodiment, a particularly advantageous flow behavior or a particularly advantageous gas exchange between the two extinguishing areas is achieved. In this respect, substantially over the entire width of the two extinguishing areas measured between the first side and the second side means at least 80%, preferably 90%, particularly preferably 100% of the width of the respective extinguishing area.

The invention is particularly advantageous when the switching device is of closed design.

According to a particularly preferred embodiment, it is thereby provided that no dedicated outlet opening is provided for the switching arc and/or for plasma generated by the switching arc within the switching device, wherein the switching device, on the other hand, is not hermetically sealed so that pressure compensation with the environment for example through gaps in a housing of the switching device is possible.

According to another particularly preferred embodiment of the present invention, the switching device is a bidirectional switching device, wherein one of the two extinguishing areas is used depending on the current direction. Further preferably, the switching device according to the present invention is a contactor.

An embodiment of the present invention is explained in more detail below with reference to drawings.

Figure 2:
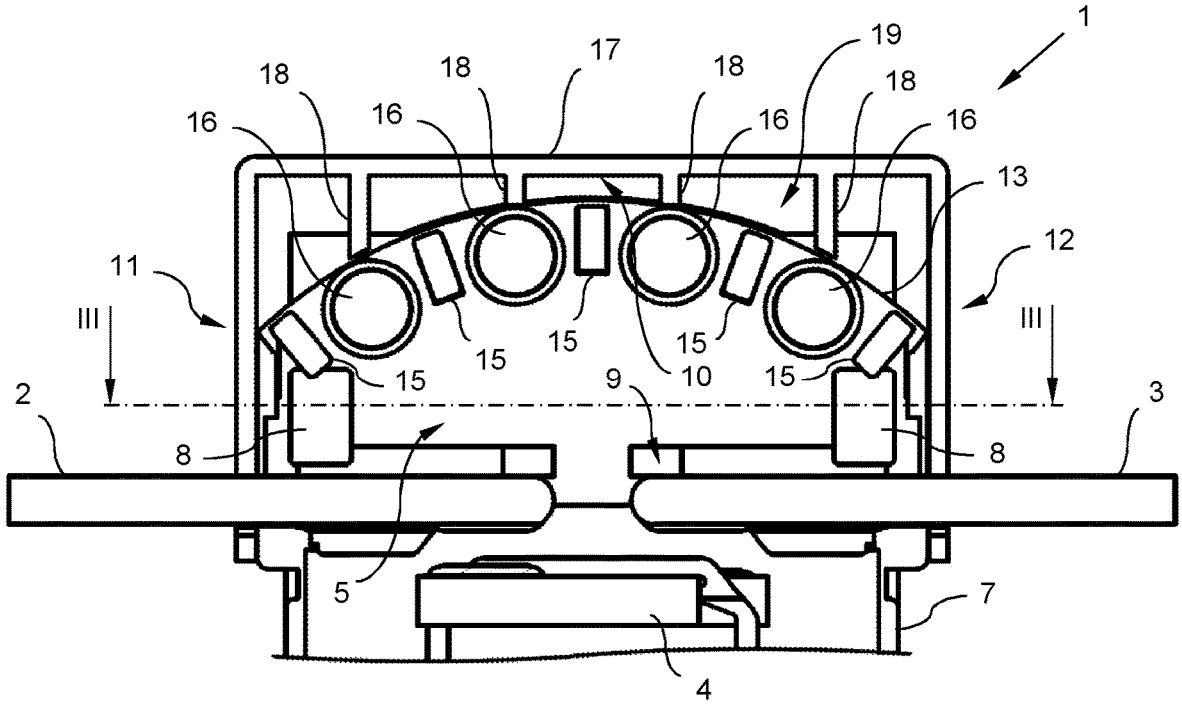
Figure 3:
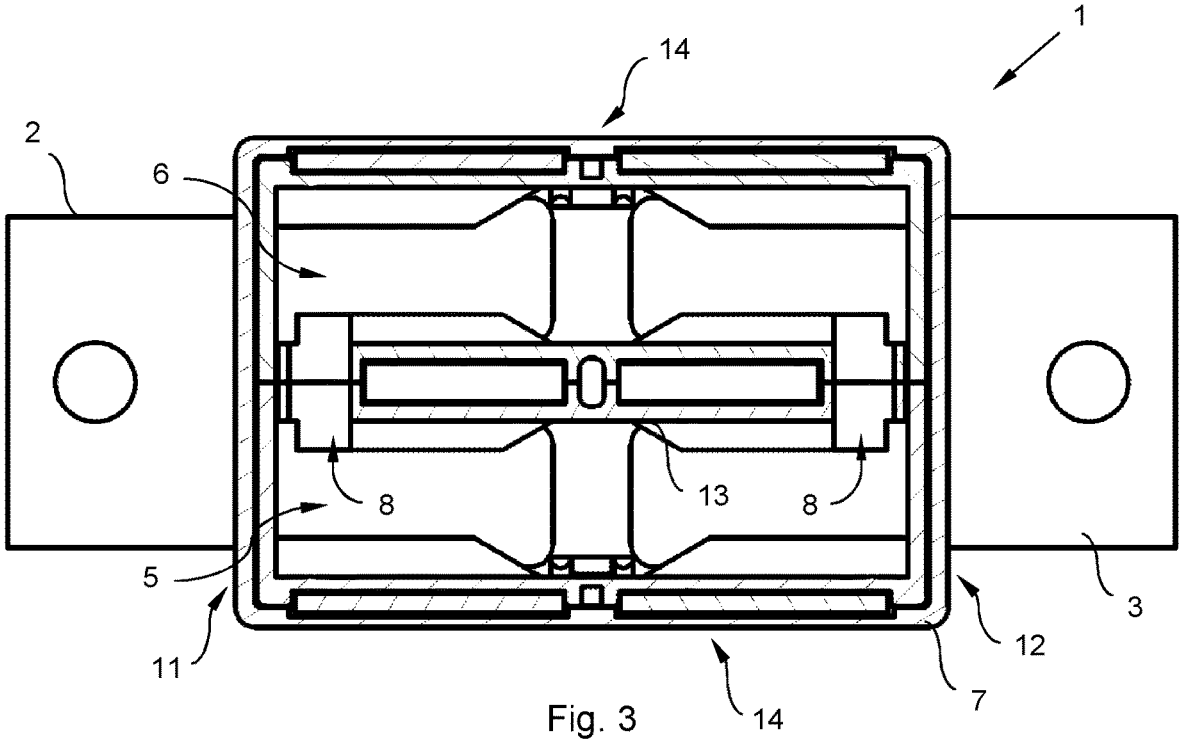
Figure 4:
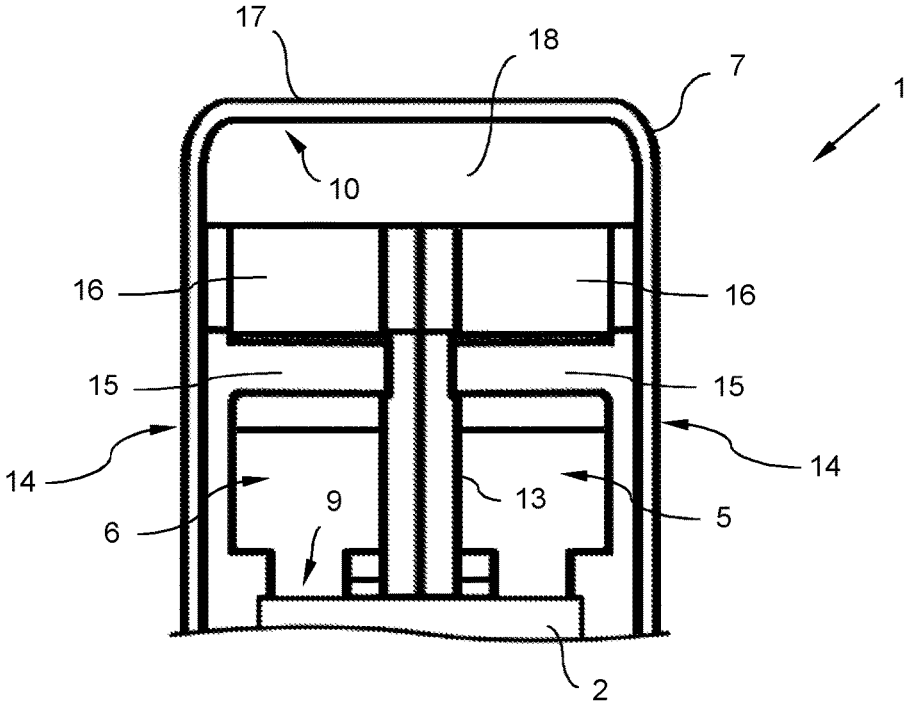

FIG. 1 shows a perspective view of a switching device according to the invention with the front of the housing in an open state and the left wall of the housing in an open state, FIG. 2 shows a front view of the switching device according to the invention in FIG. 1 with the front of the housing in an open state, FIG. 3 shows a section through the switching device according to the invention in FIGS. 1 and 2 along section line III drawn in FIG. 2, and FIG. 4 shows a side view of the switching device according to the invention in FIGS. 1 to 3 on the housing side located on the left in FIGS. 1 to 3 with the left housing wall in an open state.

In the following exemplifications, the same parts are designated by the same reference numerals. If a Figure comprises reference numerals which are not addressed in detail in the associated description of the Figure, reference is made to the preceding or following descriptions of the Figures.

FIG. 1 shows a perspective view of a switching device 1 according to the invention. In order to be able to present the features or components relevant to the invention, both the front side of the housing facing the viewer and the left wall of the housing have not been shown in the presentation in FIG. 1. For the same reason, the front of the housing is not shown in the front view in FIG. 2.

The switching device 1 has two fixed contacts 2, 3 which can be electrically connected to each other by means of a contact bridge 4. The drive of the contact bridge 4 is not important for the present invention and has therefore also not been shown further. The two fixed contacts 2, 3 project laterally from the housing 7 of the switching device 1 according to the invention and thus simultaneously form the connection contacts of the switching device.

When opening the contacts, a switching arc 20 is generated, the base point of which on the contact bridge side is caused to jump over to the opposite fixed contact by means of an appropriately configured arc blowing means. The arc blowing means then drives the switching arc 20 into the extinguishing chamber above the two fixed contacts 2, 3, where it is extinguished. The extinguishing chamber is divided by a partition wall 13 into a front first extinguishing area 5 and a rear second extinguishing area 6. For the sake of completeness, it is to be noted that the switching device shown is a bidirectional switching device. When opening the contacts, a switching arc is generated both between the first fixed contact 2 and the contact bridge 4 and between the second fixed contact 3 and the contact bridge 4. Due to a special configuration of the contact bridge 4 and a corresponding design of the arc blowing means, the base point of one of the two switching arcs jumps over from the contact bridge to the respective opposite fixed contact, which leads to the extinction of the respective other switching arc. The remaining switching arc 20 is located either in front of or behind the partition wall 13, depending on the direction of current, so that either the first extinguishing area 5 or the second extinguishing area 6 is used to extinguish the switching arc, depending on the direction of current. That is one of the two extinguishing areas is not used during the switch-off process.

The two extinguishing areas 5 and 6 of the extinguishing chamber have essentially a cuboid volume and begin above the two fixed contacts 2 and 3. The two fixed contacts 2 and 3 thus mark a lower first end 9 of the respective extinguishing area. The arc blowing means which is not shown in greater detail, is configured in such a way that it drives the switching arc 20 starting from the first end 9 of the extinguishing area to the opposite second end 10 of the respective extinguishing area, which in turn is formed by the upper side 17 of the housing. The housing wall on the left in FIG. 2 marks a first side 11 of the two extinguishing areas, while the housing wall on the right marks the opposite second side 12 of the two extinguishing areas. The partition wall 13 forms a third side of each of the two extinguishing areas. Each extinguishing area 5, 6 further has a fourth side 14 opposite the partition wall, which is formed by the respective front side of the housing or rear side of the housing, which is shown in particular in FIGS. 3 and 4.

Each of the two extinguishing areas 5, 6 has a plurality of extinguishing elements into which the switching arc is driven and thereby is extinguished. The extinguishing elements protrude from the upper end of the partition 13 or extend between the partition wall and the opposite side of the housing. In the embodiment shown, these are simple extinguishing plates 15 on the one hand and cylindrical permanent magnets 16 on the other hand, each of which is encased in a protective sleeve, attract the switching arc to itself and at the same time act as extinguishing elements or extinguishing magnets. Here it is to be noted that in FIG. 1 only the extinguishing plates 15 and permanent magnets 16 of the front extinguishing area 5 are clearly visible. The rear second extinguishing area 6 also has corresponding extinguishing elements 15 and 16, which can be seen in particular in FIG. 4.

The actual extinguishing space used by the two extinguishing areas 5 and 6 ends at the level of the extinguishing elements 15 and 16, since the switching arc 20 is caused to be extinguished by the extinguishing elements 15 and 16, assuming it does not already extinguish on its way to the extinguishing elements. On the housing side, housing ribs 18 are provided above the extinguishing elements 15 and 16. These project inwards from the top of the housing and extend over the entire depth of the two extinguishing areas 5 and 6. They prevent the arc from re-igniting above the extinguishing elements 15 and 16.

As can be readily seen from the drawings, the switching device 1 according to the invention is a closed switching device. In order to increase the switching capacity while maintaining an extremely compact construction, the switching device according to the invention has overflow openings 8 in the central partition wall 13 between the two extinguishing areas 5 and 6. Two such overflow openings 8 are located laterally in the lower portion of the partition wall, i.e. at the lower first end 9 of the two extinguishing areas. The close proximity to the lower end and to the respective side wall 11 and 12 further guarantees an effective separation of the two extinguishing areas, at least as far as an unintentional propagation or displacement of the switching arc is concerned. At the same time, the overflow openings allow a certain gas exchange between the two extinguishing areas, which contributes decisively to preventing the plasma generated inside the housing due to the switching arc from escaping to the outside.

Between the extinguishing elements 15, 16 and the upper side of the housing 17 there is a additional overflow opening 19 which extends over essentially the entire width of the two extinguishing areas, so that the partition wall 13 actually ends at the level of the extinguishing elements 15, 16. The additional overflow opening 19 increases the positive effect described above.

LIST OF REFERENCE NUMERALS

1 switching device
2 fixed contact
3 fixed contact
4 contact bridge
5 first extinguishing area
6 second extinguishing area
7 housing
8 overflow opening
9 first end of the extinguishing area
10 second end of the extinguishing area
11 first side of the extinguishing area
12 second side of the extinguishing area
13 partition wall or third side of the extinguishing area
14 fourth side of the extinguishing area
15 extinguishing element
16 extinguishing magnet
17 housing upper side
18 housing ribs
19 additional overflow opening
20 switching arc

The invention claimed is:

1. A switching device, comprising:

closable contacts; and an extinguishing chamber which is associated with the contacts, the extinguishing chamber comprising:

a first extinguishing area configured to extinguish a switching arc generated by the contacts and directed into the first extinguishing area; and a second extinguishing area configured to extinguish the switching arc generated by the contacts and directed into the second extinguishing area, the second extinguishing area being arranged directly adjacent to the first extinguishing area, the first extinguishing area and the second extinguishing area being spatially separated from each other by a partition wall, the partition wall comprising a center region, a first end portion, a second end portion opposite the first end portion, and a top end portion extending from the first end portion to the second end portion;

wherein the switching device is configured as a bidirectional switching device, with one of the first extinguishing area or second extinguishing area being used depending on a current direction, wherein the switching device is configured in such a way that the switching arc, which is generated when opening the contacts, is always blown away from a point where the switching arc is generated in one of the first extinguishing area or the second extinguishing area and is caused to be extinguished, wherein the partition wall between the first extinguishing area and the second extinguishing area has at least one overflow opening in the first end portion or the second end portion connecting the first extinguishing area to the second extinguishing area in such a way that plasma which is generated by the switching arc can flow from the first extinguishing area or the second extinguishing area in which the switching arc is caused to be extinguished into the other one of the first extinguishing area or the second extinguishing area.

2. The switching device according to claim 1, wherein the first extinguishing area or second extinguishing area each define a space having a first end closest to the point where the switching arc is generated, a second end opposite the first end and towards which the switching arc moves, a first side connecting the first end and the second end to each other and a second side opposite the first side and also connecting the first end and the second end to each other, wherein the partition wall forms a respective third side of the space and connects the first end, the second end, the first side and the second side to each other, and wherein the space further comprises a fourth side opposite the partition wall.

3. The switching device according to claim 2, wherein the at least one overflow opening is formed in a section of the partition wall, facing the first end and facing away from the second end.

4. The switching device according to claim 2, further comprising: extinguishing elements arranged at the second end or near the second end, into which the switching arc is driven and thereby caused to be extinguished.

5. The switching device according to claim 4, wherein the at least one overflow opening is formed between the extinguishing elements and a cover or a housing wall at the second end of the switching device in the partition wall.

6. The switching device according to claim 5, wherein the at least one overflow opening extends substantially over an entire width of the first extinguishing area or second extinguishing area, measured between the first side and the second side, so that the partition wall actually ends at a level of the extinguishing elements.

7. The switching device according to claim 1, wherein the at least one overflow opening is formed in the partition wall both on the first end portion and on the second end portion.

8. The switching device according to claim 1, wherein the switching device is of a closed design.

9. The switching device according to claim 8, wherein the switching device does not include a dedicated outlet opening to an environment for the switching arc and/or for plasma generated by the switching arc within the switching device, and wherein the switching device is not hermetically sealed for pressure compensation with an environment.

10. The switching device according to claim 9, wherein the not hermetically sealed switching device comprises a housing with gaps for pressure compensation with the environment.

11. The switching device according to claim 1, further comprising:

an arc blowing means comprising permanent magnets, wherein arc blowing means blows away the switching arc from the point where it is generated in one of the first extinguishing area or the second extinguishing area.

12. A switching device, comprising:

closable contacts; and an extinguishing chamber which is associated with the contacts, the extinguishing chamber comprising:

a first extinguishing area configured to extinguish a switching arc generated by the contacts and directed into the first extinguishing area; and a second extinguishing area configured to extinguish the switching arc generated by the contacts and directed into the second extinguishing area, the second extinguishing area being arranged directly adjacent to the first extinguishing area, the first extinguishing area and the second extinguishing area being spatially separated from each other by a partition wall, the partition wall comprising a center portion, a first end portion, a second end portion opposite the first end portion, and a top end portion extending from the first end portion to the second end portion;

wherein the switching device is configured as a bidirectional switching device, with one of the first extinguishing area or second extinguishing area being used depending on a current direction, wherein the switching device is configured in such a way that the switching arc, which is generated when opening the contacts, is always blown away from a point where the switching arc is generated in one of the first extinguishing area or the second extinguishing area and is caused to be extinguished, wherein the partition wall between the first extinguishing area and the second extinguishing area has at least one overflow opening at the top end portion proximate a cover or a housing wall of the switching device, the at least one overflow connecting the first extinguishing area to the second extinguishing area in such a way that plasma which is generated by the switching arc can flow from the first extinguishing area or the second extinguishing area in which the switching arc is caused to be extinguished into the other one of the first extinguishing area or the second extinguishing area.

* * * * *